United States Patent [19]

Radocha et al.

[11] Patent Number: 4,813,535

[45] Date of Patent: Mar. 21, 1989

[54] WIRE RACK DISPLAY SYSTEM WITH SIMPLIFIED RE-STOCKING FEATURES

[75] Inventors: Michael J. Radocha, Greenfield; James J. Jarecki, Greendale, both of Wis.

[73] Assignee: EZ Paintr Corporation, Milwaukee, Wis.

[21] Appl. No.: 93,858

[22] Filed: Sep. 8, 1987

[51] Int. Cl.[4] ..... A47F 5/08

[52] U.S. Cl. ..... 206/44.12; 206/44 R; 206/45.11; 206/367; 206/499; 211/65; 211/88; 211/106; 211/133; 211/181; 248/220.4; 312/42

[58] Field of Search ..... 206/44 R, 44 K, 44.11, 206/44.12, 45.11, 361, 362, 362.4, 499; 211/133, 181, 65, 66, 59.1, 59.2, 88, 106, 70.6, 89, 90, 119; 248/220.3, 220.4, 221.2, 221.1; 312/39–45, 35; 220/22, 23.83, 18, 18.1, 22.1, 22.2

[56] References Cited

U.S. PATENT DOCUMENTS

| | | | |
|---|---|---|---|
| 1,612,903 | 1/1927 | Bitney | 211/133 X |
| 2,300,412 | 11/1942 | Fink | 211/133 X |
| 2,560,896 | 7/1951 | Rubenstein | 211/106 |
| 2,743,020 | 4/1956 | Rubenstein | 211/181 X |
| 2,905,330 | 9/1959 | Lilja | 211/59.2 |
| 2,954,125 | 9/1960 | Husted | 248/220.9 X |
| 3,502,295 | 3/1970 | Kalbow et al. | 211/88 X |
| 3,528,558 | 9/1970 | Williams | 211/59.2 |
| 3,568,830 | 3/1971 | Moren | 206/499 |
| 3,732,976 | 5/1973 | Bessett et al. | 206/499 X |
| 3,994,115 | 11/1976 | Mako et al. | 206/499 X |
| 4,036,369 | 7/1977 | Eisenberg | 211/88 |
| 4,177,903 | 12/1979 | Edelson et al. | 211/70.6 X |
| 4,248,352 | 2/1981 | White | 211/88 |
| 4,511,047 | 4/1985 | Elinsky | 211/181 X |
| 4,540,093 | 9/1985 | Merl et al. | 211/59.1 |
| 4,648,524 | 3/1987 | Ackermann | 220/22 |

*Primary Examiner*—Stephen Marcus
*Assistant Examiner*—Bryon Gehman
*Attorney, Agent, or Firm*—James G. Staples

[57] ABSTRACT

A wire-frame display rack system for mounting on a vertical pegboard, comprising a pair of spaced-apart arms with both vertical and horizontal members, a rectangular wire frame forming back and side walls, elongated mounting hooks secured together by a horizontal member, and a carton containing the products to be displayed. The rack is removably attached to the mounting hooks, which are removably attached to the vertical pegboard. The display rack is configured for easy removal and replacement of the carton, allowing for quick and efficient re-stocking of the products for display.

7 Claims, 6 Drawing Sheets

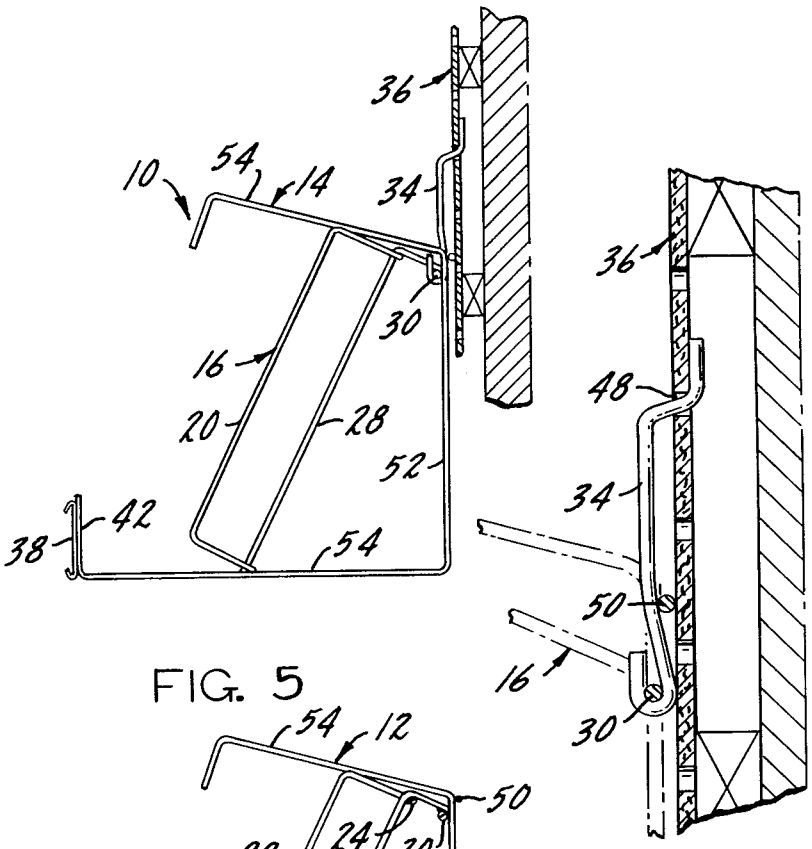
FIG. 5
FIG. 8
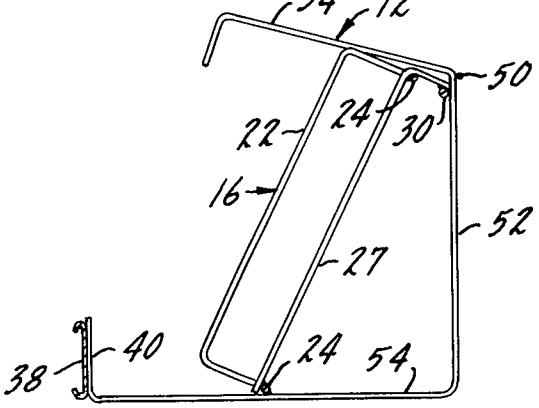
FIG. 7
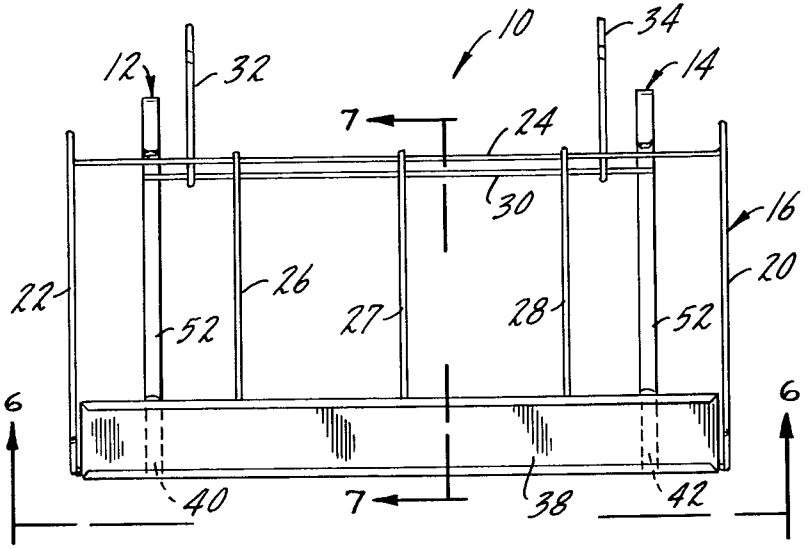
FIG. 4
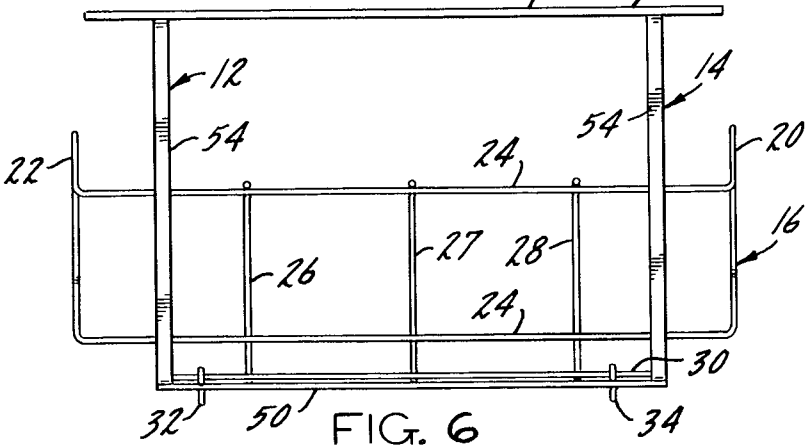
FIG. 6

11a

12a

13a

14a

WIRE RACK DISPLAY SYSTEM WITH SIMPLIFIED RE-STOCKING FEATURES

BACKGROUND OF THE INVENTION

1. Field of the Invention

This invention relates to an improved display system particularly designed for products which are not easily stocked and re-stocked for sale.

2. Description of the Prior Art

The display system of the present invention is particularly useful in stocking paint brushes and paint rollers. It is typical that paint brushes are stocked for sale by hanging the handles thereof on a wire or the like disposed to project substantially horizontally from a vertically disposed display. The handles of the paint brushes have holes in them for receiving therethrough the wires projecting from the display. Paint rollers are sometimes stocked in substantially the same fashion, by laying them horizontally across two spaced-apart wires which project horizontally from a vertically disposed display, or by simply placing them in a bin-type holder affixed to the vertically disposed display.

These past methods of stocking products like paint brushes and paint rollers, in many cases, are generally satisfactory, particularly in stores which do not deal in large volumes. However, in the large warehouse-type marketing operations which depend on large volumes, stocking the displays in these past methods is time consuming and costly. The time and the expense of continually re-stocking the displays is even greater, since the time and expense increases as the volume of sales increase. Accordingly, it is an object of the present invention to provide an improved display system which is particularly useful in stocking and re-stocking products such as paint brushes, paint rollers and the like which normally are not easily stocked and re-stocked. In this respect, the display system is of a design such that a large quantity of the product can be effectively stocked in bulk, in an attractive manner, and can likewise be re-stocked.

SUMMARY OF THE INVENTION

The above objective as well as others not specifically mentioned are accomplished with the display system of the invention which includes, generally, a wire rack which is adapted to be removably affixed to a vertical wall, preferably a peg board wall, of a display shelf, counter or the like. The wire rack is designed to removably support, preferably in an inclined vertical position, a container or carton containing a number of the products which are disposed therein such that the products are readily seen by prospective purchasers and can be easily and quickly selected and removed from the container or carton.

The wire racks are affixed to the vertical wall in spaced-apart relationship, in both horizontal and vertical rows, such that when the containers or cartons are placed on and supported by the wire racks virtually a wall of the products are displayed for the prospective purchasers.

The wire racks also are provided with indicia inserts on them into which product identification and information cards or the like can be removably supported to assist the purchasers in selecting the particular product he needs or desires. Accordingly, the individual products displayed in the wall of products can be easily identified by the purchaser, and can be easily and quickly re-arranged if it is desirable to do so. In this respect, those responsible for re-stocking the products also can easily ascertain those particular products which need re-stocking.

The containers or cartons preferably are formed to receive therein a large quantity of the products, usually twelve, with the products being disposed therein such that the products are automatically placed for display purposes when the containers or cartons are placed on the wire racks. In this respect, in packaging paint brushes, for example, the cartons may contain dividers for separating and maintaining the paint brushes in aligned rows so that an attractive organized display of the paint brushes is presented to the purchasers. The products such as the paint brushes are separately disposed within the cartons so that the individual ones of the products can be easily selected and removed from the carton, without dis-arranging the display of products. The display of the products therefore always is neat and well organized.

The cartons for the products preferably also form part of the storage and/or shipping carton for the products, such that the portion thereof containing the products to be displayed can be easily and quickly separated, and that entire portion easily and quickly placed on the wire racks so that a large quantity of the products can be re-stocked all at one time, without having to handle the individual ones of the products. It has been established that this aspect of the invention has reduced considerably the time and expense of re-stocking the products.

DESCRIPTION OF THE DRAWINGS

FIG. 4 is a top plan view of the wire rack of FIG. 1;

FIG. 5 is a side plan view of the wire rack of FIG. 1 illustrating the manner in which it is removably affixed to a vertical wall;

FIG. 6 is a bottom view taken along lines 6—6 of FIG. 4;

FIG. 7 is a sectional view taken along lines 7—7 of FIG. 4;

FIG. 8 is an enlarged side plan view illustrating the manner in which the hooks of the wire rack are removably secured to the vertical wall;

Figure 11:
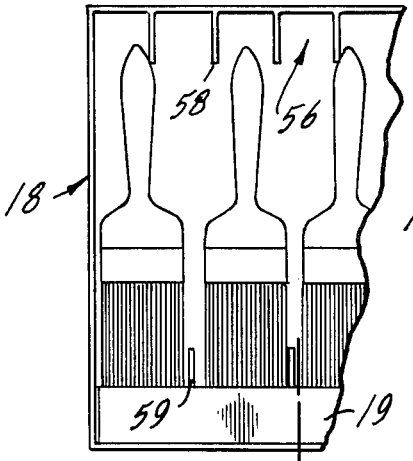
FIG. 11 is a partial top plan view of a carton generally illustrating how products of different dimensions are disposed and separated in the carton for display.
Figure 12:
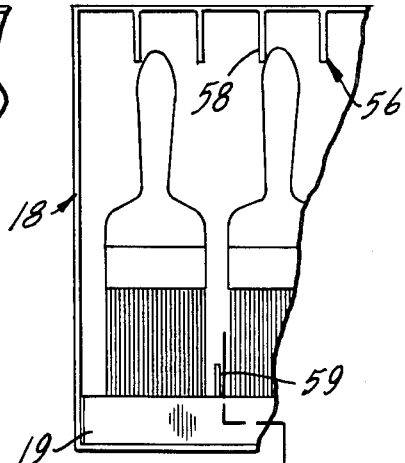
Figure 11A:
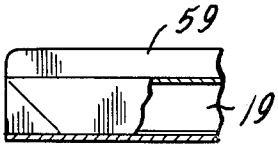
Figure 12A:
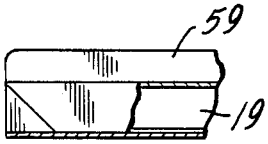
Figure 13:
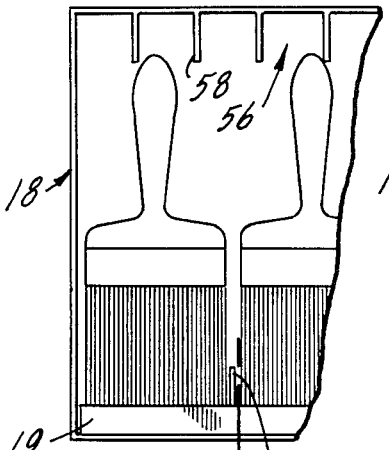
Figure 14:
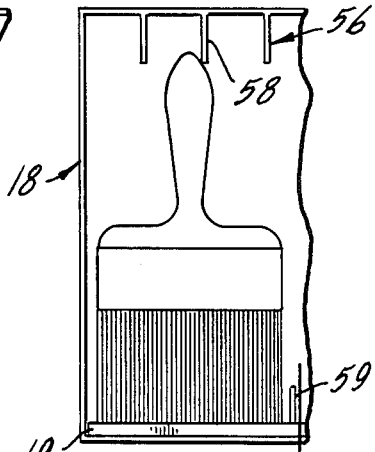
Figure 13A:
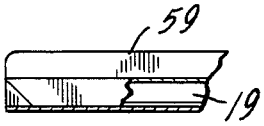
Figure 14A:
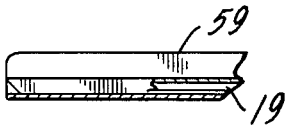
Figure 20:
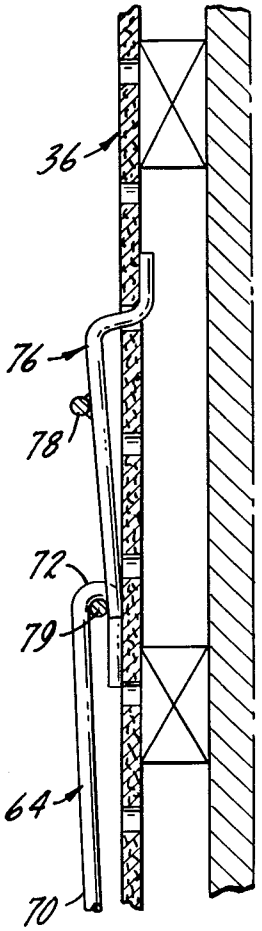
Figure 17:
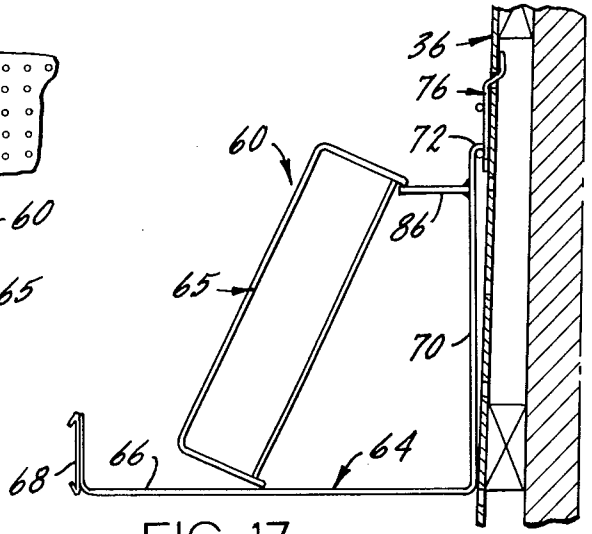
Figure 19:
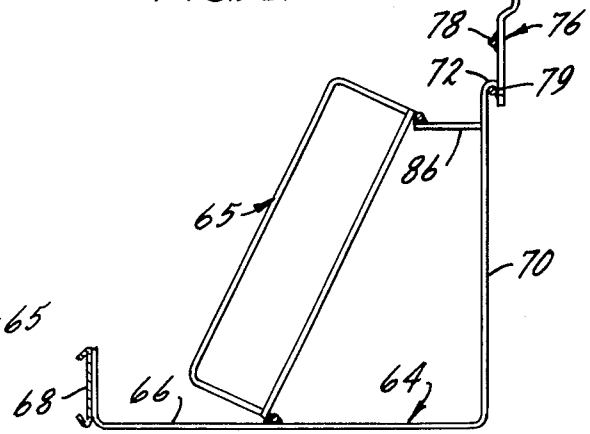
Figure 16:
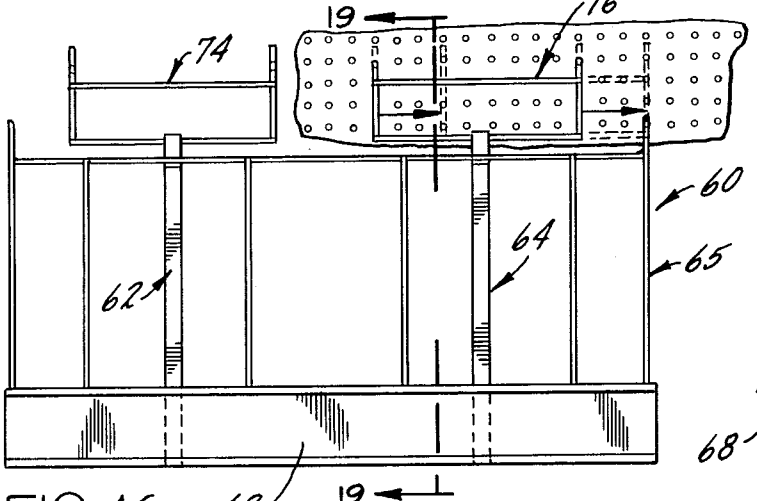
Figure 18:
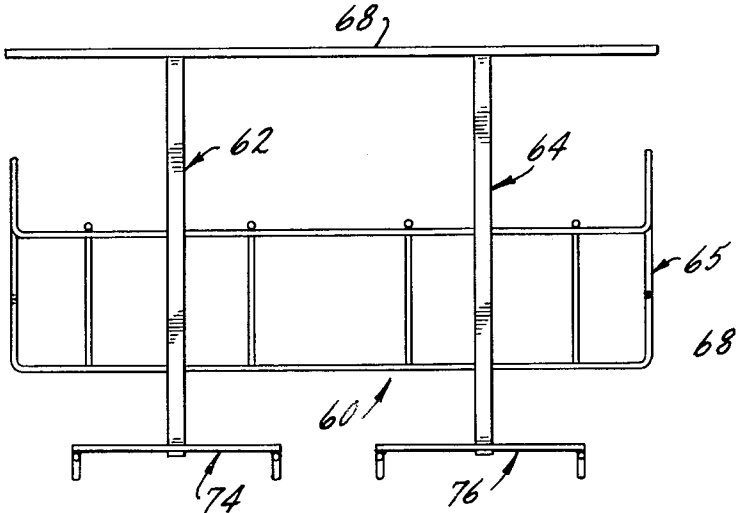
Figure 15:
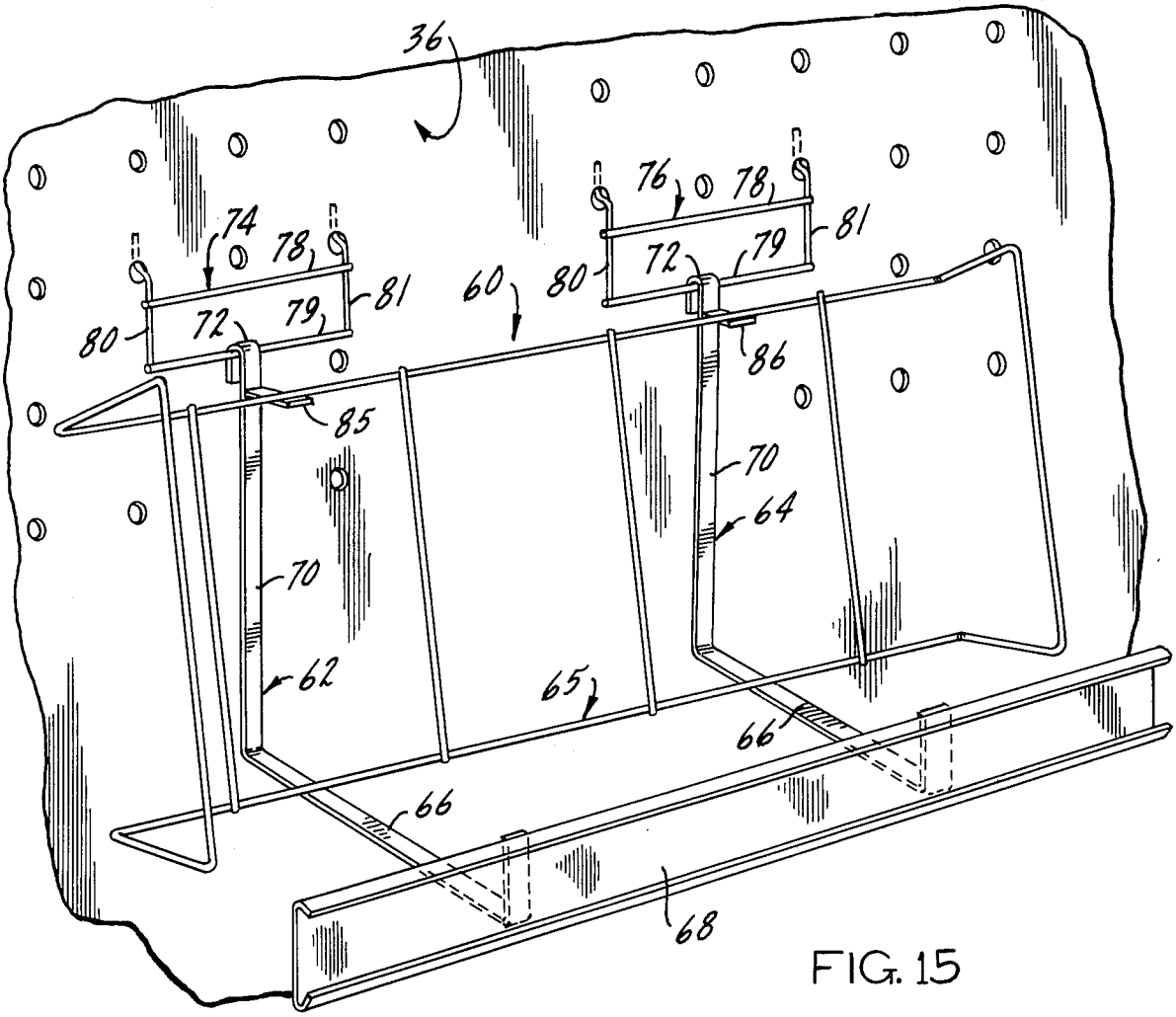
Figure 21:
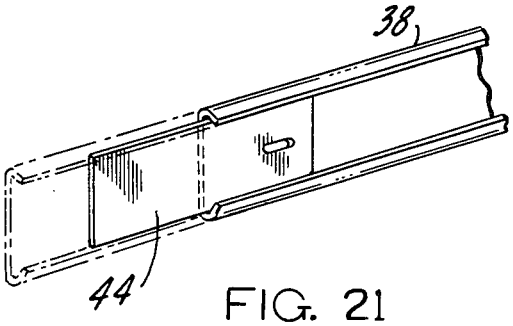

FIG. **11*a* is a sectional view taken generally along line 11*a* of FIG. 11**;

FIG. 12 is another partial top plan view of a carton generally illustrating how products of different dimensions are disposed and separated in the carton for display;

FIG. 12*a* is a sectional view taken generally along line 12*a* of FIG. 12;

FIG. 13 is still another partial top plan view of a carton generally illustrating how products of different dimensions are disposed and separated in the carton for display;

FIG. 13*a* is a sectional view taken generally along line 13*a* of FIG. 13;

FIG. 14 is still another partial top plan view of a carton generally illustrating how products of different dimensions are disposed and separated in the carton for display;

FIG. 14*a* is a sectional view taken generally along line 14*a* of FIG. 14;

FIG. 15 is a front perspective view of another wire rack exemplary of another embodiment of the invention;

FIG. 16 is a front plan view of the wire rack of FIG. 15 affixed to a vertical wall;

FIG. 17 is a side plan view of the wire rack of FIG. 15 affixed to a vertical wall;

FIG. 18 is a bottom plan view of the wire rack of FIG. 15;

FIG. 19 is a sectional view taken along lines 19—19 of FIG. 16;

FIG. 20 is an enlarged, partially sectionalized side view generally illustrating how the hooks of the wire rack of FIG. 15 are removably affixed to a vertical wall; and FIG. 21 is a partial front perspective view generally illustrating the manner in which elongated cards bearing indicia pertaining to the products can be removably inserted in the U-shaped members of the wire racks.

DESCRIPTION OF THE INVENTION

Figure 1:
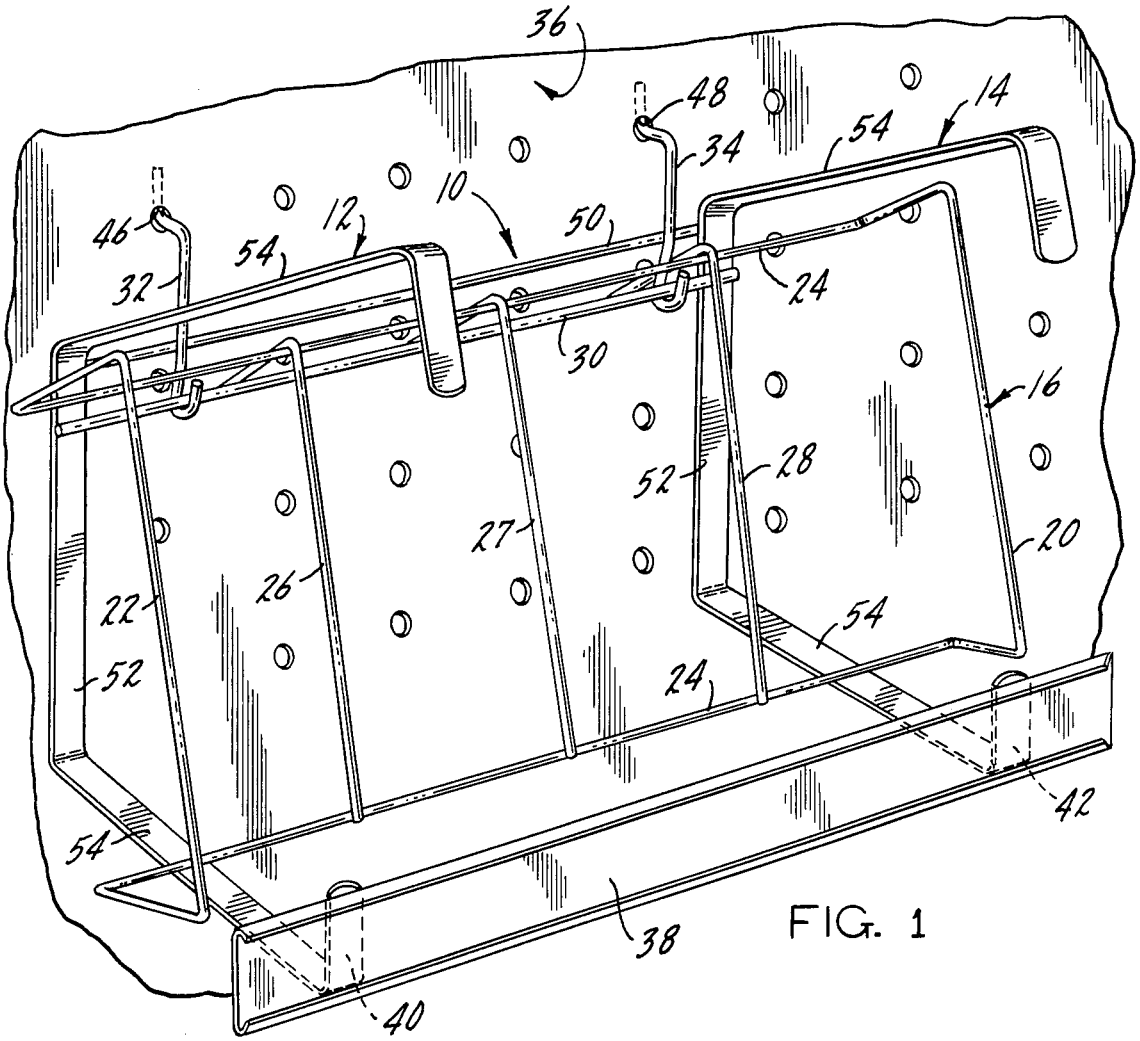
FIG. 1 is a perspective view of a wire rack exemplary of one embodiment of the invention as it is removably affixed to a vertical wall.

Referring now to the drawings, in FIG. 1 there is illustrated a wire rack 10 exemplary of one embodiment of the improved display system of the invention. The wire rack 10 in this instance includes two spaced-apart, generally C-spaced arms 12 and 14 to which is fixedly secured a wire frame member 16 that functions to support for display a carton 18 of products (FIG. 2), as more specifically described below. The wire frame member 16 includes a rectangular portion, the opposite ends of which are folded upwardly to effectively form two opposed side walls 20,22 projecting from a back wall 24. The back wall 24 further is formed by three additional L-shaped wire braces 26–28 which are fixedly secured thereto, and to a wire 30 that functions both to secure in spaced-apart relationship the two C-shaped arms 12,14 and to support the wire rack 10 on two hooks 32,34 which, in turn, function to removably secure the wire rack 10 to a vertical wall 36. As can be best seen in FIGS. 5 and 7, the wire frame member 16 is fixedly secured within and between the two C-shaped arms 12,14 to be vertically inclined at an angle from the front to the rear of the wire rack 10.

The two C-shaped arms 12,14 further are affixed in spaced-apart relationship by the back wall 24 of the wire frame member 16, and by a generally U-shaped member 38 which is fixedly secured between and to the lower ends 40,42 of the respective ones of the C-shaped arms 12,14, which lower ends 40,42 are folded to extend substantially vertically. The U-shaped member 38 is adopted to slideably receive therein an elongated rectangular card 44 (FIG. 21) to which can be affixed indicia providing information pertaining to the product displayed on the wire rack 10.

The hooks 32,34 have one end thereof formed to engage about the wire 30. The other end of the hooks 32,34 are formed to be received within holes 46,48 in the vertical wall 36. In this regard, it is preferred that the vertical wall 36 be a peg-board wall of the type well-known in the industry having horizontally and vertically aligned rows of holes. The hooks 32,34 further are affixed to a wire 50 extending between and affixed to the two C-shaped arms 12,14. The wire 50 retains the hooks 32,34 in vertically disposed, spaced-apart relationships so that they are easily inserted in the holes such as the holes 46,48 in the vertical wall 36.

The two C-shaped arms 12,14 each have vertical portions 52 which abut against the vertical wall 36 when the wire rack 10 is affixed to the vertical wall, and horizontal portions 54 which support a carton 18 placed in the wire rack 10. The ends of these horizontal portions 54 are folded vertically upwardly, and the U-shaped member 38 is affixed to these ends. The upper ends of the two C-shaped arms 12,14 extend outward from the vertical portions 52 and are angled upwardly on a slight incline towards the front ends thereof. The ends then are folded to extend vertically downward, and effectively form stops for retaining the carton 18 in the wire rack 10.

Figure 2:
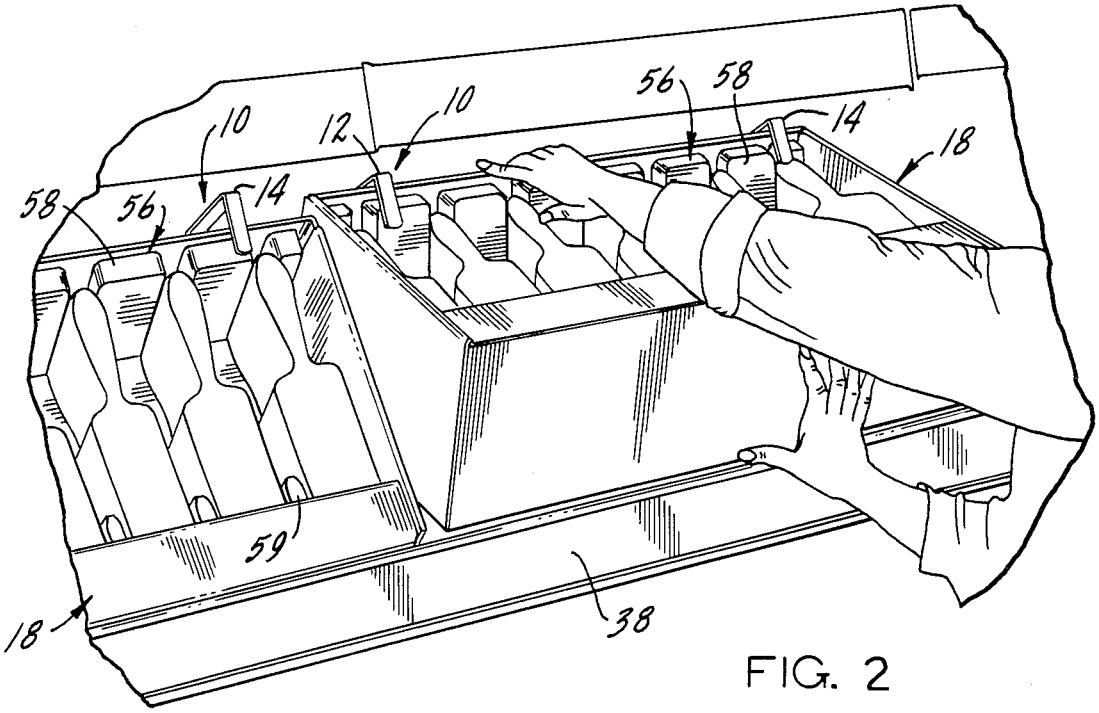
FIG. 2 is a perspective view generally illustrating the manner in which cartons containing products are placed in and supported by the wire racks.
Figure 3:
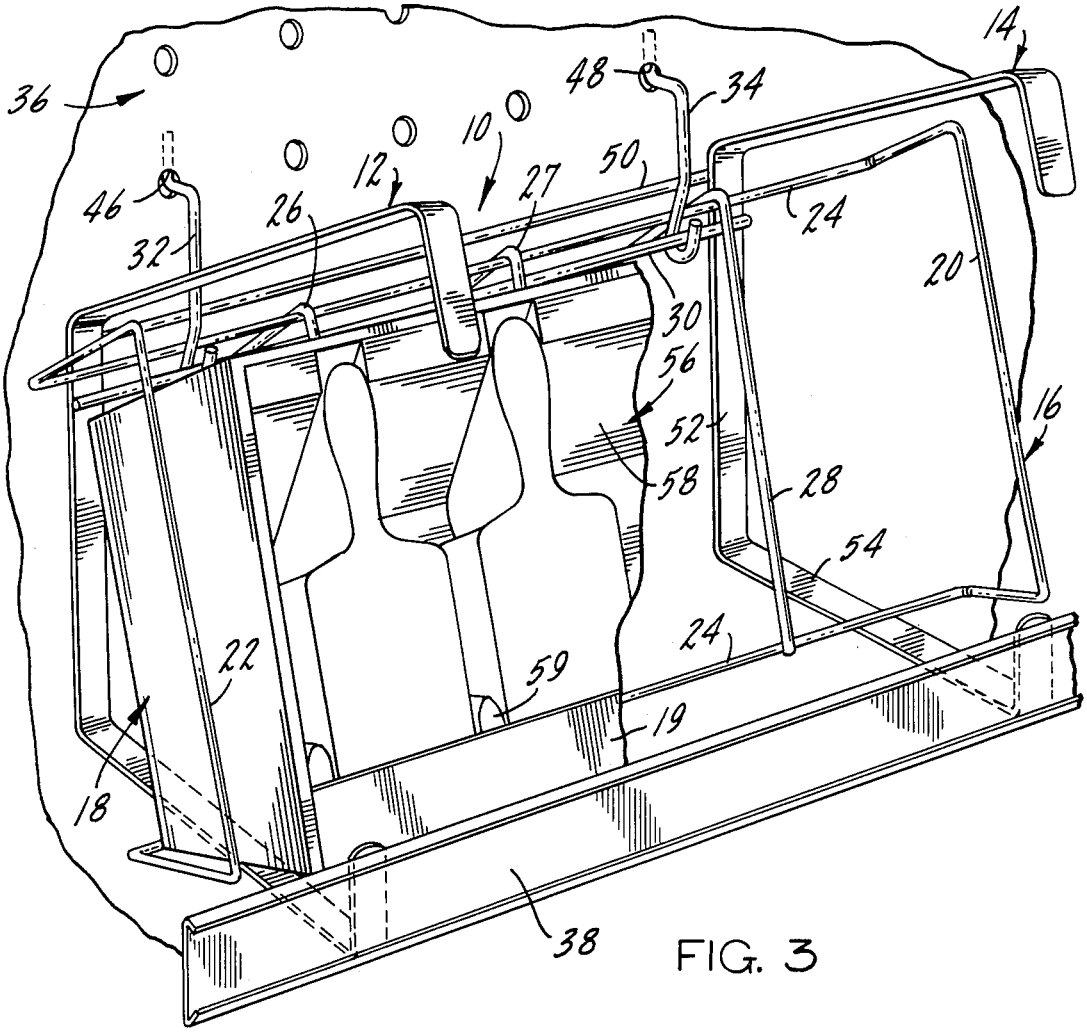
FIG. 3 is a perspective view, partially sectionalized, illustrating a carton containing products as it is seated in a wire rack.
Figure 9:
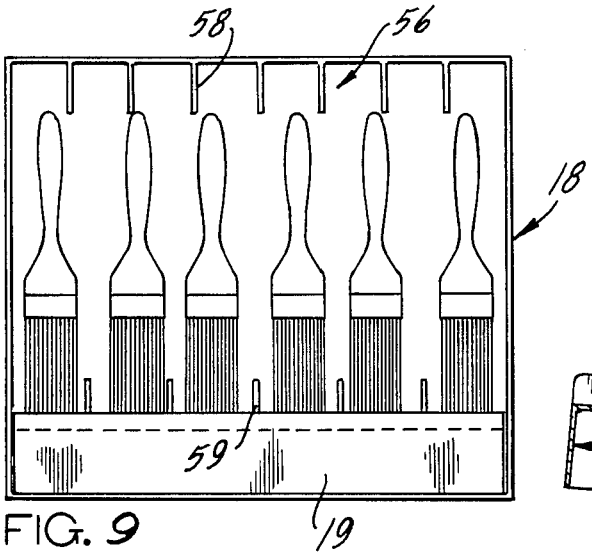
FIG. 9 is a top plan view generally illustrating the manner in which the products are disposed within a carton.

As indicated above, the products to be displayed are packaged in quantities, usually a dozen, in cartons 18 which are proportioned to be placed in the wire racks 10. As can be seen in FIGS. 2,3, and 9–14, the cartons 18 preferably are generally open top rectangular boxes made of corrugated paperboard, and the products, paint brushes as illustrated, are stocked flat atop one another in aligned rows in the cartons 18. In the case of paint brushes, the cartons 18 can have spacers 56 affixed therein to separate and to maintain the paint brushes in an organized fashion in the cartons. As illustrated in FIGS. 2 and 3, the spacers 56 can be vacuum-formed plastic inserts 58,59 which are affixed to the opposed walls of the carton 18 and which are formed to retain the upper ends of the handles and the brush positions of the paint brushes, respectively.

Alternatively, as illustrated in FIGS. 9–14, the spacers 56 can be simply corrugated paperboard dividers 58 disposed within the cartons 18 to separate and to maintain the paint brushes in an organized fashion in the cartons.

Figure 10:
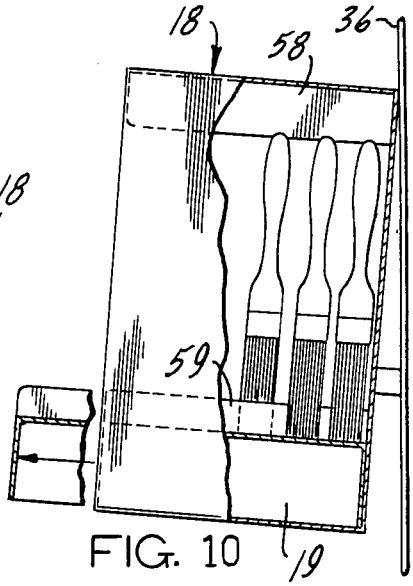
FIG. 10 is a side plan view, partially sectionalized, illustrating the manner in which the cartons are supported by the wire racks to display the products contained therein.

Preferably all of the cartons 18 for a particular product are of the same size so that all of the cartons containing those products can be organized on the vertical wall 36, either horizontally or vertically, in rows which correspond in size so that a neat, organized attractive display of products can be provided. As indicated above, virtually a wall of products thus can be organized and displayed. In order to compensate for products of different lengths, the cartons 18 can be provided with a false bottom 19, as illustrated in FIG. 10.

In the case of many products such as paint rollers, paint trays, scrapers and the like, and even paint brushes, the products can be simply stocked in the cartons in a bulk fashion in any fashion so as to provide a display which appears orderly. Obviously, it is preferred to retain the products in an orderly display, but the primary objective of the improved display rack is to enable the products to be initially quickly and easily stocked for display and to be able to subsequently restock the display easily and quickly in the least amount of time and expense by eliminating the need to handle individual ones of the products during stocking and re-stocking. This objective is basically accomplished by packaging the products in quantities, in bulk or in a separated fashion, in cartons 18 which can be easily and quickly placed in a wire rack 10.

As indicated above, the cartons 18 are open top cartons proportioned to be received in the wire racks 10. The cartons 18, while not shown, advantageously are received within another open top carton which is placed over the carton 18 to close it and to form a shipping and storage container for the products. When it is desired to display the products, the carton which functions to close the carton 18 is simply removed and the carton 18 then is ready to be placed in a wire rack 18 to display the products.

In placing the carton 18 in a wire rack 18, the upper edge of the carton 18 is disposed behind the upper vertically disposed ends of the two C-shaped arms 12,14, as illustrated in FIG. 2, and the carton 18 then is seated in the wire rack 10 by pivotally rotating the lower side of the carton until it is properly seated. When seated, the open face of the carton 18 will be angularly inclined such that the products therein can be easily seen. Preferably and advantageously, a number of wire racks 10 which are to support a number of cartons 10 containing the same products, such as paint brushes, rollers, paint trays or the like, are affixed to the vertical wall 36 in horizontally and/or vertically aligned rows so that when the cartons 18 are placed in the wire racks 10 all of the products of a like kind are orderly displayed in an attractive fashion on the vertical wall. By organizing the wire racks 10 on the vertical wall 36 in this fashion and placing cartons 18 containing like products therein, a wall of products whether they be the same or different but of related uses can be attractively displayed. The display also can be quickly set up since the individual products do not have to be separately handled. It is only necessary to place a carton containing a large quantity of the products on the individual ones of the wire racks 10.

The same is true in re-stocking the display. A carton 18 is simply removed from a wire rack 10, and replaced with another full carton 18. Therefore, the time and expense of stocking and re-stocking the display is substantially reduced.

The layout of the display also can be easily and quickly changed, if desired, by simply re-locating and arranging the wire racks 10 affixed to the vertical wall 36. This is easily accomplished simply by dis-engaging the hooks 32,34 from the holes 46,48 in the vertical wall 36, and re-engaging them in the holes in the vertical wall in the desired locations.

Each of the products in a carton 18 seated in a wire rack 10 can be identified and information concerning the product conveyed to the perspective purchasers by providing the same on an elongated card 44 and slidably inserting the same in the U-shaped member 38 affixed to the C-shaped arms 12,14 of the wire racks 10.

In FIGS. 15–20, there is illustrated a modified wire rack and means for affixing it to the vertical wall 36. In this case, the wire rack 60 has two generally L-shaped arms 62,64 and a wire frame member 65 which is generally like the wire frame member 16 affixed to them.

The L-shaped arms 62,64 have horizontally extending portions 66 which have the ends thereof folded vertically upwardly. A U-shaped member 68 which is adapted to slidably and removably receive therein an elongated card for providing product information is affixed to the vertically disposed ends of the horizontal portions 66.

The L-shaped arms 62,64 also have vertically extending portions 70 which have the ends thereof reversely folded to form a hook 72. These hooks 72 are adapted to engage with separate mounting members 74,76 respectively that are removably affixed to the vertical wall 36. The mounting members 74,76 are of a like construction, including two horizontal disposed wires 78,79 which are affixed to a pair of spaced-apart elongated hook members 80,81 that are adapted to be received and retained within the holes in the vertical wall 36.

The wire frame member 65 is affixed to the L-shaped arms 62,64 so as to be vertically inclined like the wire-frame member 16 of the wire rack 10. In this case, the wire frame member 65 is affixed to the horizontal portions 66 of the L-shaped arms 62,64, and to two horizontally extending mounting bars 85,86 affixed to the vertical portions 70 of the respective ones of the L-shaped arms 62,64.

This construction of the wire rack 60 permits the mounting members 74,76 to be first affixed to the vertical wall 36, and the rack portion thereof to be subsequently affixed to the mounting members 74,76 simply by engaging the hooks 72 with one of the wires 78,79 of the mounting members 74,76.

Otherwise, the wire rack 60 functions in the same fashion as the wire rack 10 to receive therein cartons 18 to display products.

What is claimed is:

1. An improved display system for displaying products such that the products can be easily and quickly stocked and re-stocked on a display stand having a substantially vertical wall with a plurality of substantially horizontal and vertical rows of holes formed therein comprising, in combination:

a wire rack comprising a pair of spaced-apart arms, each of which has a substantially vertically disposed portion and a substantially horizontally disposed portion, a wire-frame member which is generally rectangular shaped and which has two opposed sides thereof folded substantially vertically so as to form a back wall and two opposed side walls, said wire-frame member being secured to said pair of spaced-apart arms such that said back wall thereof is disposed at an angularly inclined angle with the lower edge thereof disposed forwardly from the upper edge thereof, attachment means comprising a pair of mounting members, each of said pair of mounting members comprising a pair of spaced-apart elongated hook members and at least one wire member securing said hook members together, said pair of spaced-apart arms of said wire rack having associated therewith a hook portion adapted to engage with said wire member of said mounting members, said spaced-apart elongated hook members being removably secured within said holes in said substantially vertical wall and said wire rack being removably secured to said mounting members, and a carton containing a plurality of products to be displayed, said carton having a bottom wall, side walls and an open top, and proportioned to be received within said wire rack, said products being disposed within said carton such that individual ones of said products are substantially visible to a party when said carton is placed in said wire rack;

said products being initially stock on said display stand by placing a carton containing a plurality of said products in said wire rack, thereby eliminating the need to handle individual ones of said products and being re-stocked by removing said carton and replacing it with another carton containing a plurality of said products, thereby substantially reducing the time and expense normally incurred in stocking and re-stocking products for display.

2. The improved display system of claim 1, wherein said plurality of products are stocked in rows one atop the other in said carton, said carton including means therein for separating said rows of stocked products.

3. The improved display system of claim 2, wherein said means for separating said rows of stocked products comprises corrugated paperboard separators.

4. An improved display system for displaying products such that the products can be easily and quickly stocked and restocked on a display stand having a substantially vertically wall with a plurality of substantially horizontal and vertical rows of holes formed therein comprising, in combination:

a wire rack comprising a pair spaced-apart arms, each of which has a substantially vertically disposed portion and substantially horizontally disposed supper and lower portions, and each of which is generally C-shaped, the ends of said substantially horizontally disposed upper and lower portions being folded substantially vertically downwardly and upward, respectively, to form stops for removably containing a carton seated within said wire racks, a wire-frame member which is generally rectangular shaped and which has tow opposed sides thereof folded substantially vertically so as to form a back wall and two opposed side walls, said wire-frame member being secured to said pair of spaced-apart arms such that said back wall thereof is disposed at an angularly inclined angle with the lower edge thereof disposed forwardly from the upper edge thereof, attachment means comprising at least a pair of hooks which are removably engageable within said holes in said substantially vertical wall to removably secure said wire rack to said substantially vertical wall, and a carton containing a plurality of products to be displayed, said carton having a bottom wall, side walls, and an open top, and proportioned to be received within said wire rack, said products being disposed within said cartons such that individual ones of said products are substantially visible to a party when said carton is placed in said wire rack;

said products being initially stocked on said display stand by placing a carton containing a plurality of said products in said wire rack, thereby eliminating the need to handle individual ones of said products, and being re-stocked by removing said carton and replacing it with another carton containing a plurality of said products, thereby substantially reducing the time and expense normally incurred in stocking and re-stocking products for display.

5. The improved display system of claim 4, wherein the attachment means comprise a pair of mounting members, each of which mounting members further comprise a pair of spaced-apart elongated hook members and at least one wire member securing said hook members together, said pair of spaced-apart arms of said wire rack having associated therewith a hook portion adapted to engage with said wire member of said mounting members, said spaced-apart elongated hook members being removably secured within said holes in said substantially vertical wall and said wire rack being removably secured to said mounting members.

6. The improved display system of claim 4, wherein said plurality of products are stocked in rows one atom the other in said carton, said carton including means therein for separating said rows of stocked products.

7. The improved display system of claim 6, wherein said means for separating said rows of stocked products comprises corrugated paperboard separators.

* * * * *